US007681252B1

(12) United States Patent
Petry

(10) Patent No.: US 7,681,252 B1
(45) Date of Patent: Mar. 23, 2010

(54) MOISTURE-DIVERTING SWEATBAND

(76) Inventor: Robert W. Petry, 4390 N. Riverside Dr., Columbus, IN (US) 47203

( * ) Notice: Subject to any disclaimer, the term of this patent is extended or adjusted under 35 U.S.C. 154(b) by 303 days.

(21) Appl. No.: 11/657,336

(22) Filed: Jan. 24, 2007

(51) Int. Cl.
*A42C 5/00* (2006.01)

(52) U.S. Cl. ..... 2/181; 2/174

(58) Field of Classification Search ..... 2/162, 2/170, 171, 174, 181, 181.2, 181.4, 181.6, 2/181.8, 182.1–182.8; 132/212
See application file for complete search history.

(56) References Cited

U.S. PATENT DOCUMENTS

| | | | | | |
|---|---|---|---|---|---|
| 2,320,782 | A | | 6/1943 | Larsen | 2/171 |
| 4,481,680 | A | * | 11/1984 | Mason et al. | 2/174 |
| 4,521,922 | A | | 6/1985 | Mitchell et al. | 2/171 |
| 4,630,317 | A | | 12/1986 | Brown et al. | 2/12 |
| 4,638,512 | A | | 1/1987 | Frankel | 2/171 |
| 5,113,533 | A | * | 5/1992 | Takada | 2/170 |
| 5,313,668 | A | | 5/1994 | Bogan et al. | 2/181.4 |
| 5,471,683 | A | | 12/1995 | Moretz et al. | 2/181 |
| D375,385 | S | * | 11/1996 | Mock | D28/20 |
| 5,745,921 | A | | 5/1998 | Mitchell et al. | 2/181 |
| 5,920,910 | A | | 7/1999 | Calvo | 2/181.4 |
| 5,940,885 | A | * | 8/1999 | Matthews | 2/174 |
| 6,353,936 | B2 | * | 3/2002 | Flatt | 2/174 |
| 6,584,984 | B2 | * | 7/2003 | Kelly | 132/212 |
| 6,971,122 | B2 | | 12/2005 | Sanchez | 2/181.6 |
| 2001/0047536 | A1 | | 12/2001 | Flatt | 2/181 |
| 2003/0221241 | A1 | | 12/2003 | Rivera et al. | 2/170 |
| 2007/0079423 | A1 | * | 4/2007 | Flatt | 2/181.6 |

FOREIGN PATENT DOCUMENTS

| | | | |
|---|---|---|---|
| JP | 2000136461 | A2 | 5/2000 |
| WO | WO 2004/025350 | A1 | 3/2005 |

* cited by examiner

*Primary Examiner*—Gary L Welch
*Assistant Examiner*—Sally Colson Cline
(74) *Attorney, Agent, or Firm*—Woodard, Emhardt, Moriarty, McNett & Henry LLP

(57) ABSTRACT

A continuous loop, elastomeric band for encircling a portion of a user's head, according to one embodiment of the present invention, comprises a main body including a center hub and a plurality of curved fins, each fin having a curved shape tapering to an outer tip and at least one pair of adjacent fins cooperatively defining a moisture-collecting channel. Each fin includes a convex side and opposite thereto a concave side. The moisture-collecting channel being defined by the convex side of one fin and the concave side of an adjacent fin.

14 Claims, 4 Drawing Sheets

MOISTURE-DIVERTING SWEATBAND

BACKGROUND OF THE INVENTION

The present disclosure relates generally to a moisture-diverting sweatband that routes the moisture away from the forehead area, above the eyes, to a remote location. More specifically, the present disclosure relates to an elastomeric sweatband that creates both a moisture barrier and collection structure that is configured with three or more wings. These wings permit the sweatband to be placed around the head of the user in any one of a plurality of orientations while still functioning in a virtually identical manner regardless of the selected orientation.

In the field of sweatbands, the most basic designs typically include a panel or thickness of some moisture-absorbent material and then a tie or band or elastic member to help secure that panel to or around some selected area of the user's anatomy. In some of these basic designs, the panel is annular and includes some degree of elasticity so when placed around the area of anatomy, such as the head or arm, it will maintain itself in that selected position. In terms of the moisture-absorbent material, a typical construction involves terry cloth and, depending on the size, the sweatband would typically be used around the wrist, arm, or head. Alternatively, the panel of material can be an absorbent paper or similar composition and this construction typically requires a tie or band of some type since the absorbent paper is typically not created with an elastic filler or structure.

These various types of prior art sweatbands rely on their material absorbency to collect the moisture at or near the site of generation. As such, with continued use, the moisture content of the sweatband increases until the sweatband becomes saturated. At that point, the sweatband needs to be wrung out or replaced with a dry sweatband or discarded, if of a disposable configuration.

Over the years, new sweatband designs have emerged as a way to address the moisture saturation issue. There are two general categories of sweatband improvements. One category includes material changes and the other includes structural changes. These structural changes include material laminations and shapes to help direct the moisture away from a particular area or region of the user. Some of the sweatband designs that have emerged include both material changes as well as structural changes in form or construction. For the most part, some type or degree of absorption of moisture is a part of these prior art constructions. In contrast, the structures disclosed herein, as examples of the present invention, do not include any moisture absorption, at least nothing noticeable, and instead the disclosed structures simply incorporate a blocking or abutment to the moisture with a channeling or trough-type structure so as to collect and then divert moisture from one area of the user to a remote location. More specifically, the designs disclosed herein place the sweatband around the forehead or upper head portion of the user so as to block any moisture from the face and then channeling the collected moisture to a location behind the ears where that collected moisture is able to empty onto the ground or down the back of the user.

Another aspect generally of the prior art sweatbands for the head is the need for the sweatband to have a specific, singular orientation relative to the head. There is a requirement to have a specific placement so that any design features provided for absorption will be properly positioned. In contrast, some of the structures disclosed herein can be positioned around the head without regard to any specific orientation. In effect, these sweatbands are of a uniform configuration throughout the continuous loop construction, providing greater versatility as to the intended method and manner of use.

The sweatband embodiments disclosed herein are considered to be novel and unobvious based upon their disclosed structural features which may include one or more of the structural differences noted above.

BRIEF SUMMARY

A continuous loop, elastomeric band for encircling a portion of a user's head, according to one embodiment of the present invention, comprises a main body including a center hub and a plurality of curved fins, each fin having a curved shape tapering to an outer tip and at least one pair of adjacent fins cooperatively defining a moisture-collecting channel.

One object of the present disclosure is to provide an improved continuous loop, elastomeric sweatband.

DETAILED DESCRIPTION

Figure 1:
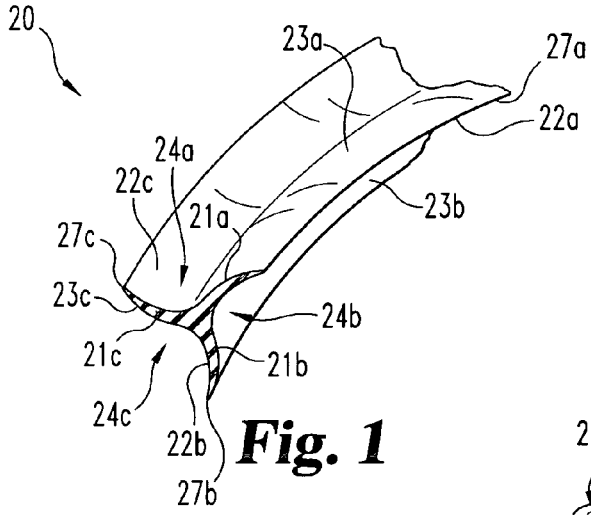
FIG. 1 is a partial, perspective view with one end in full section according to a typical embodiment of the present invention.

For the purposes of promoting an understanding of the disclosure, reference will now be made to the embodiments illustrated in the drawings and specific language will be used to describe the same. It will nevertheless be understood that no limitation of the scope of the disclosure is thereby intended, such alterations and further modifications in the illustrated device and its use, and such further applications of the principles of the disclosure as illustrated therein being contemplated as would normally occur to one skilled in the art to which the disclosure relates.

Figure 1A:
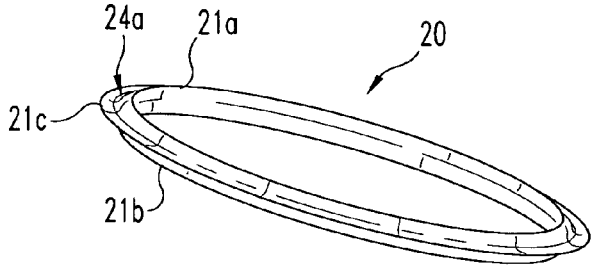
FIG. 1A is a perspective view of the full, continuous loop elastomeric band that is partially illustrated in FIG. 1.

Referring to FIGS. 1 and 1A, there is illustrated an elastomeric sweatband 20 according to a first disclosed embodiment. As is illustrated in FIG. 1A, the elastomeric sweatband 20 has a continuous closed loop form so as to be able to encircle the head of the user (see FIG. 2). FIG. 1 illustrates the lateral section shape of the continuous closed loop sweatband 20 illustrated in FIG. 1A. This illustrated lateral section shape is uniform and continuous throughout the entirety of the continuous closed loop form. While a number of elastomeric materials may be used, the preferred material is rubber latex due to its toughness, its ability to retain its elasticity over time in various environmental conditions, and its low moisture absorption properties. As will be understood, sweatband 20 is constructed and arranged so as to fit around the head of the user with a snug fit so as to create an abutment or blockage for any sweat that would form above the sweatband and would otherwise have a tendency or likelihood of running down into the face and eyes of the user. In terms of an understanding of what "snug" means in the context of this disclosure, the intent is to size the sweatband 20 relative to the head size of the user such that there is a barrier to the passage or flow of moisture between the headband and the head of the user, at least in the forehead area, where the band is applied directly to the skin, without being so tight that there is discomfort to the user or resultant headaches.

With continued reference to FIG. 1, the lateral section form of sweatband 20 includes three curved fins 21*a*, 21*b* and 21*c*, that are equally spaced apart. Generally, the concave side 22 of one fin 21 is facing, though spaced-apart from, the convex side 23 of the next, adjacent fin 21. More specifically, fin 21*a* includes a concave side 22*a* and a convex side 23*a*. Fin 21*b* includes a concave side 22*b* and a convex side 23*b*. Fin 21*c* includes a concave side 22*c* and a convex side 23*c*. As is illustrated, concave side 22*a* faces convex side 23*b*, concave side 22*b* faces convex side 23*c*, and concave side 22*c* faces convex side 23*a*. Further, and as is illustrated, there is a channel 24*a*, 24*b*, and 24*c*, respectively, defined by and positioned between each pair of adjacent fins 21*a*, 21*b*, and 21*c*.

Figure 2:
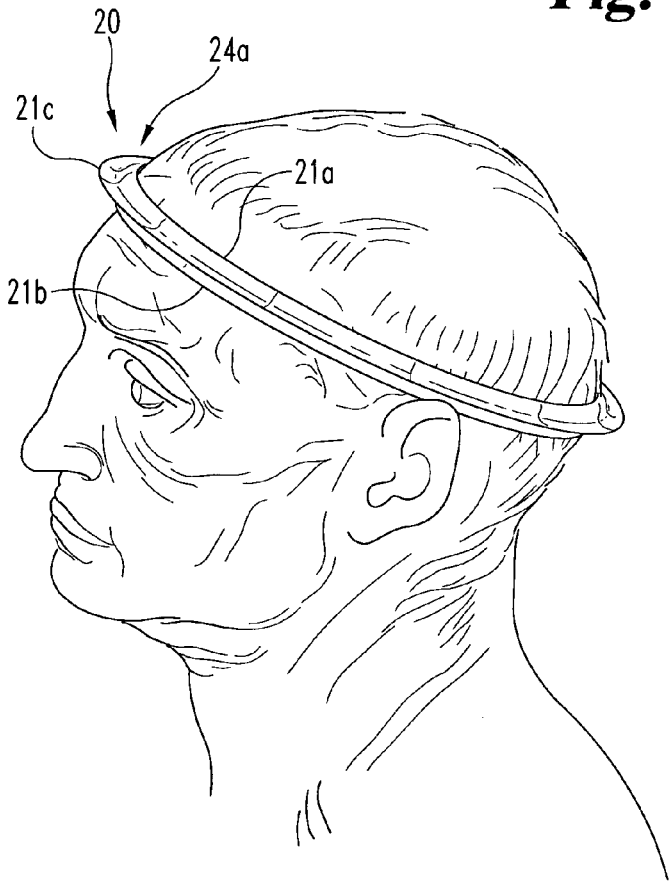
FIG. 2 is a perspective view of the FIG. 1A continuous loop, elastomeric sweatband as applied around the head of a user, according to the present invention.

Each fin 21*a*, 21*b*, and 21*c* has a sectional shape that smoothly converges from center hub 26 to the corresponding outer tips 27*a*, 27*b*, and 27*c*, respectively. The tapering of the curved concave and convex sides of each fin into the corresponding outer tip results in a tip shape that appears to be pointed, a result of the fin material being very thin at the outermost tip or free end. The uniformly spaced construction of the three identical fins 21*a*, 21*b*, and 21*c* of sweatband 20 would conceivably allow the band to be turned and twisted and to be applied similarly to the head of the user (i.e., worn as illustrated in FIG. 2) in a plurality of orientations. As is illustrated in FIG. 2, the sweatband 20 is applied to the head of the user so as to be positioned in the face area across the forehead and above the eyes. The orientation of sweatband 20 at the back of the head results in positioning of the sweatband at a slightly lower position extending above the ears and then extending rearwardly and downwardly. In the orientation selected for FIG. 2, fins 21*a* and 21*b* are the selected fins to be applied directly against the user's forehead. More specifically, in the illustrated embodiment, when the elastomeric sweatband 20 is stretched around the head of the user, the concave surface 22*a* of fin 21*a* is applied against the upper portion of the forehead and the convex surface 23*b* of the adjacent fin 21*b* is applied against the lower portion of the forehead. This orientation positions channel 24*a* in a forwardly facing, upwardly opening position.

Conceivably, the sweatband 20 is able to be arranged around the head of the user in other orientations, with the right twisting and turning, in addition to the orientation illustrated in FIG. 2. In other orientations, either channel 24*b* or channel 24*c* would be configured relative to the head of the user in the forwardly-facing, upwardly-opening position. Sweatband 20 functions the same and equally, regardless of which one of the possible orientations is the one actually selected for application of the sweatband to the head of the user.

The elastomeric nature of sweatband 20, combined with proper sizing relative to the head size of the user, means that the sweatband 20 will be stretched slightly in order to be applied around the head of the user. By creating the described snug fit, and noting that two of the fins are applied directly against the forehead, any sweat that would be generated above the sweatband 20 in the area of the face will not pass between the fins of the sweatband and the forehead. Instead, what actually happens is that the sweat that is generated above the sweatband 20 actually flows over the upper fin 21*a* (see FIG. 2) and downwardly into channel 24*a*. As the moisture accumulates in channel 24*a* and considering the overall orientation of the sweatband 20 as it is applied around the head of the user, the accumulated moisture (sweat) is diverted to the back of the head, behind the ears, where the channel 24*a* is able to be emptied, either through the accumulation of additional moisture or due to motion and activity by the user.

For proper sizing, sweatband 20 is offered in size ranges similar to hats. The nature of the fit is such that the sweatband 20 only needs to be stretched for fitting such that sweat does not flow between the inner surface of the sweatband and the forehead of the user. This means that the sweat will flow over the sweatband into the corresponding channel 24*a*, 24*b* or 24*c*, and accumulate in that channel rather than flowing into and around the eyes and across the face of the user. A fine tune adjustment in the snugness of the elastic fit is achieved by simply pulling the sweatband 20 lower behind the ears where the head circumference is a little less.

As noted, as the moisture from sweating accumulates in channel 24*a*, the higher front portion relative to the lower rear portion or positioning of sweatband 20 around the head of the user causes the moisture to flow downwardly and rearwardly. Then, a combination of head movement and channel capacity (and perhaps channel orientation at the back of the head) causes the moisture that has accumulated in channel 24*a* and diverted to a location behind the ears to spill out and fall to the ground or simply drain down the back of the user. By either way or combination, it is noted that moisture from sweating is not running into the eyes or across the face of the user and this is one of the objectives.

In certain sporting and exercise activities, a helmet or other headgear may be worn. The construction and arrangement of sweatband 20 are fully compatible with such helmets and other headgear and sweatband 20 is constructed and arranged to be worn in combination with these other items. Sweatband 20 is uniquely suited to be worn with such helmets and other headgear because there is never an issue with sweatband 20 of needing to be replaced due to moisture saturation. Further, there is never a need to remove the helmet or other headgear to wipe off sweat from the forehead or around the eyes or face of the user.

Figure 3:
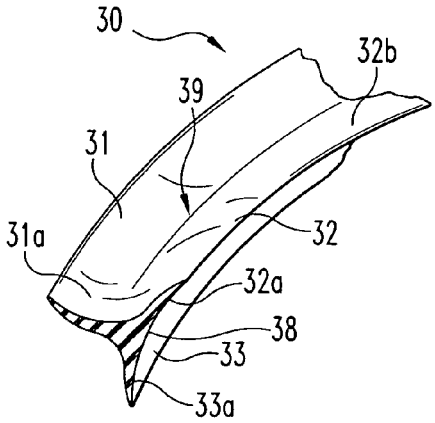
FIG. 3 is a partial, perspective view with one end in full section according to another embodiment of the present invention.
Figure 3A:
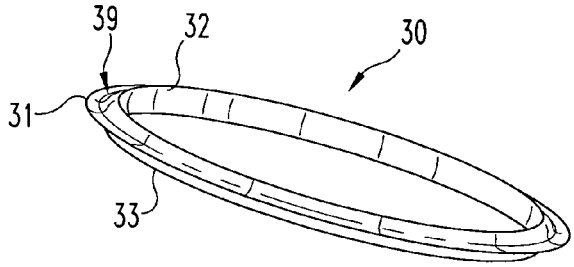
FIG. 3A is a perspective view of the full, continuous loop elastomeric band that is partially illustrated in FIG. 3.
Figure 4:
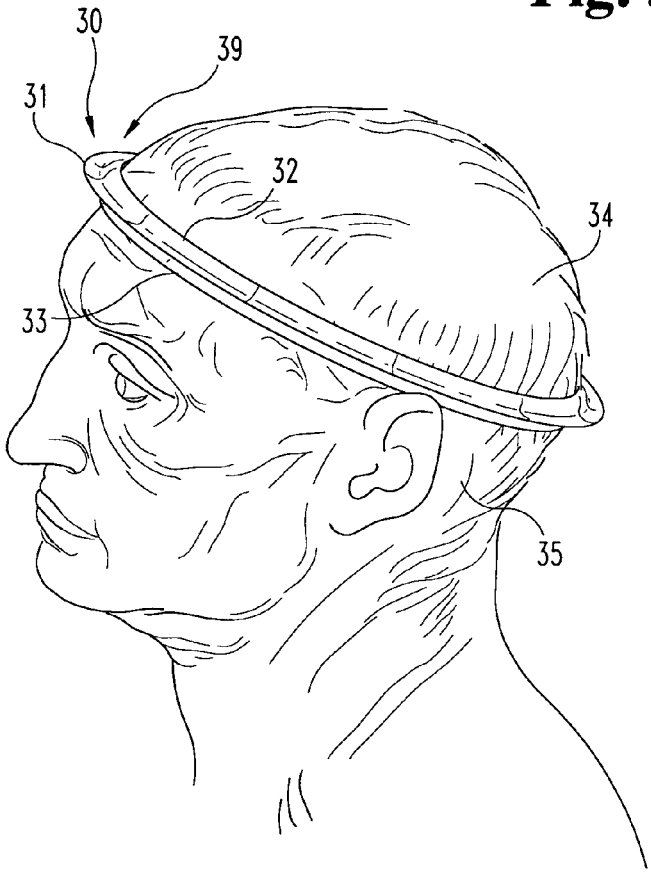
FIG. 4 is a perspective view of the FIG. 3A continuous loop, elastomeric sweatband as applied around the head of a user, according to the present invention.

Referring now to FIGS. 3, 3A, and 4, another embodiment is disclosed. Elastomeric sweatband 30 is identical in fit and function to sweatband 20 in all respects and descriptions including the intended use, except for the specific shape of the three curved fins 31, 32 and 33. While the three curved fins 21*a*, 21*b*, and 21*c* of sweatband 20 were identical to each other and equally spaced-apart in a uniformly radiating spoke-like pattern, fins 31, 32 and 33 each have a slightly different cross sectional configuration from each other and accordingly a single "proper" orientation on the head 34 of the user 35.

Fins 32 and 33 are similar to each other with curved shapes that are similar and of similar orientation. Fin 32 extends upwardly so as to be applied against the upper portion of the forehead of the user 35. Fin 33 extends downwardly so as to be applied to a lower portion of the forehead of the user. The concave surfaces 32*a* and 33*a* of fins 32 and 33, respectively, are similarly curved and aligned to create the appearance of a smoothly and uniformly curved, continuous surface 38.

Fin 31 has an upwardly facing, concave curved surface 31*a* that cooperates with convex surface 32*b* to form a moisture-collecting channel 39. The application to the head, the use to collect moisture, and the diverting of the moisture to a location remote from the forehead of sweatband 30 are all virtually the same as those aspects of sweatband 20. As noted, the only real difference between sweatband 30 and sweatband 20 is that sweatband 20 can conceivably be "properly" applied in a plurality of orientations, while sweatband 30 technically has only one "proper" orientation.

Figure 5:
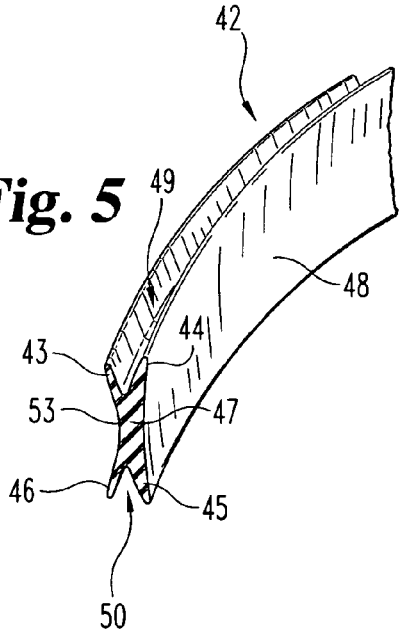
FIG. 5 is a partial, perspective view with one end in full section according to another embodiment of the present invention.
Figure 5A:
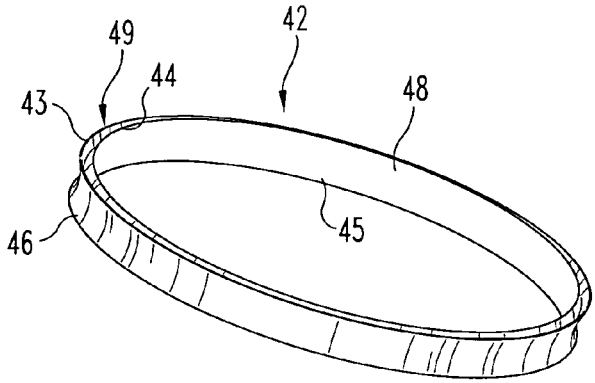
FIG. 5A is a perspective view of the full, continuous loop elastomeric band that is partially illustrated in FIG. 5.
Figure 6:
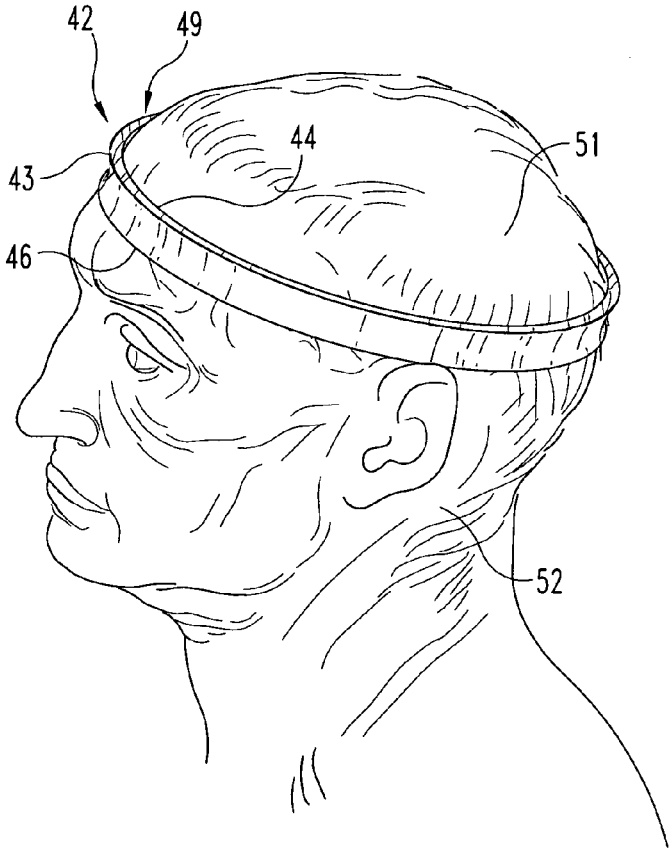
FIG. 6 is a perspective view of the FIG. 5A continuous loop, elastomeric sweatband as applied around the head of a user, according to the present invention.

Referring now to FIGS. 5, 5A and 6, another embodiment is disclosed. Elastomeric sweatband 42 includes an arrangement of four fins 43, 44, 45, and 46, that each extend from a center section 47 in an outwardly extending direction. The shapes, curvature and orientation of fins 44 and 45 cooperate to provide a smoothly curved, continuously concave surface 48. With surface 48 applied against the head of the user, fins 43 and 44 cooperate to define a first moisture-collecting channel 49. Fins 45 and 46 also cooperate to define a second moisture-collecting channel 50. When sweatband 42 is oriented on the head 51 of the user 52 based on its FIG. 5 orientation, with concave surface 48 around the head, channel 49 is the channel that collects moisture from the user. If sweatband 42 is flipped over, top to bottom, based on the FIG. 5 orientation, then moisture-collecting channel 50 becomes the upwardly directed and opening channel and it is this channel that is used for collecting moisture from the head of the user 52.

Another option for orienting sweatband 42 around the head of the user is to flip the sweatband 42 inside-out so that fins 43 and 46 are applied directly to and around the head of the user. The shapes, curvature, and orientations of fins 43 and 46 cooperate to provide a smoothly curved, continuously concave surface 53. With surface 53 applied against the head of the user, either channel 49 or channel 50 can be oriented as the upwardly directed and opening channel in order to collect moisture from the head of the user 52.

Figure 7:
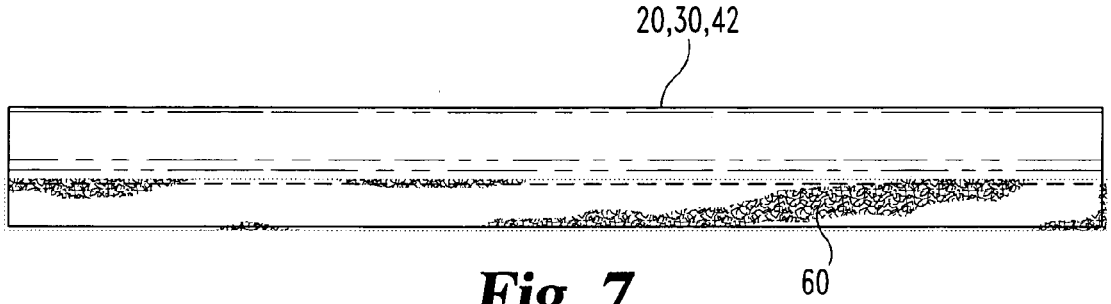
FIG. 7 is a side elevational view of an alternative embodiment of the present invention.

An alternative embodiment of the present invention is illustrated in FIG. 7 wherein a cloth sweatband 60 of otherwise typical construction is attached along the lower edge of any one of the rubber sweatbands 20, 30 or 42. The reference to "lower edge" refers to that edge of the rubber sweatband that is closest to the eyes of the user when placed around the head. The method of attachment of cloth sweatband 60 to the rubber sweatband can be by sewing, the use of an adhesive, or by sections of VELCRO® if it is desired for the cloth sweatband 60 to be removable.

It is assumed that the rubber sweatband 20, 30 or 42 will be worn high on the head (forehead), just below the hair line. This leaves room for cloth sweatband 60, preferably of a terry cloth material, to be positioned between the lower edge of the rubber sweatband and immediately above the eyes. The use of sweatband 60 is intended to absorb any moisture that might drip over the outer surface of the rubber sweatband as well as absorb any moisture that might form below the rubber sweatband.

While the preferred embodiment of the invention has been illustrated and described in the drawings and foregoing description, the same is to be considered as illustrative and not restrictive in character, it being understood that all changes and modifications that come within the spirit of the invention are desired to be protected.

The invention claimed is:

1. A continuous closed loop, elastomeric band for encircling a user's head with a snug fit, said elastomeric band comprising:

a main body constructed and arranged as a continuous closed loop of elastomeric material including a center hub and several curved fins, each fin having a curved shape tapering to an outer tip wherein each pair of adjacent fins cooperatively defining a moisture-collecting channel.

2. The continuous closed loop, elastomeric band of claim 1 wherein each fin includes a concave side and opposite thereto a convex side.

3. The continuous closed loop, elastomeric band of claim 2 wherein said several curved fins are equally spaced-apart in a radiating pattern.

4. The continuous closed loop, elastomeric band of claim 3 wherein each channel is defined by a convex side of one fin and by a concave side of an adjacent fin.

5. The continuous closed loop, elastomeric band of claim 1 which further includes a cloth band attached to an edge of said elastomeric band.

6. A continuous closed loop, elastomeric band for encircling a user's head with a snug fit, said elastomeric band comprising:

a main body constructed and arranged as a continuous closed loop of elastomeric material including a center section and four fins extending outwardly from said center section, said four fins including a first curved upper fin and a first curved lower fin cooperatively defining a first concave surface constructed and arranged for direct placement around the head of the user and a second curved upper fin and a second curved lower fin cooperatively defining a second concave surface constructed and arranged for direct placement around the head of a user, said first and second curved upper fins defining a first moisture-collecting channel opening in an upward direction and said first and second curved lower fins defining a second moisture-collecting channel.

7. The continuous closed loop elastomeric band of claim 6 which further includes a cloth band attached to an edge of said elastomeric band.

8. The continuous closed loop, elastomeric band of claim 5, wherein each fin includes a concave side and opposite thereto a convex side.

9. The continuous closed loop, elastomeric band of claim 8, wherein said several curved fins are equally spaced-apart in a radiating pattern.

10. The continuous closed loop, elastomeric band of claim 9, wherein each channel is defined by a convex side of one fin and by a concave side of an adjacent fin.

11. The continuous closed loop, elastomeric band of claim 5, wherein said several curved fins are equally spaced-apart in a radiating pattern.

12. The continuous closed loop, elastomeric band of claim 1, wherein said several curved fins are equally spaced-apart in a radiating pattern.

13. The continuous closed loop, elastomeric band of claim 6, wherein each fin is defined by a pair of converging curved surfaces.

14. The continuous closed loop, elastomeric band of claim 13, which further includes a cloth band attached to an edge of said elastomeric band.

* * * * *